United States Patent [19]

Shino et al.

[11] Patent Number: 4,826,147

[45] Date of Patent: May 2, 1989

[54] PAPER FEED CASSETTE

[75] Inventors: Satoshi Shino; Akira Sasahara; Kiyoshi Ishikawa; Shigeru Shibasaki; Shinji Takashina, all of Ebina, Japan

[73] Assignee: Rank Xerox Limited, London, England

[21] Appl. No.: 647,306

[22] Filed: Sep. 4, 1984

[51] Int. Cl.[4] ..... B65H 1/00

[52] U.S. Cl. ..... 271/145

[58] Field of Search ..... 271/145, 9, 24, 126, 271/127, 160, 162, 147, 170, 171, 184, 225

[56] References Cited

U.S. PATENT DOCUMENTS

| | | | |
|---|---|---|---|
| 1,867,738 | 7/1932 | Fraser | 206/449 |
| 3,635,468 | 1/1972 | Suzuki | 271/61 |
| 3,758,105 | 9/1973 | Okamota | 271/127 |
| 3,847,387 | 11/1974 | Sick | 271/171 |
| 4,032,136 | 6/1977 | Komaba et al. | 271/160 |
| 4,106,763 | 8/1978 | Tani et al. | 271/9 |
| 4,245,831 | 1/1981 | Michatek | 271/171 |
| 4,343,461 | 8/1982 | Tomimori et al. | 271/22 |

*Primary Examiner*—Douglas C. Butler

*Attorney, Agent, or Firm*—William A. Henry, II

[57] ABSTRACT

A dual purpose cassette is disclosed that allows the feeding of sheets in either a short edge or long edge direction. The cassette has openings on the short edge and long edge of its base and side portions so that depending on which direction the cassette is inserted into the machine sheets can be fed in the longitudinal or lateral directions.

4 Claims, 1 Drawing Sheet

PAPER FEED CASSETTE

BACKGROUND OF THE INVENTION

This invention relates to a cassette for feeding paper for further processing, and more particularly to a cassette that is adapted to feed sheets in a copying machine.

PRIOR ART

Conventional devices of this type are described with reference to FIGS. 1*a*, 1*b*, and FIG. 2. FIG. 1*a* is a perspective view of a conventional cassette case, and FIG. 1*b* is a plan view of that case. In the drawings, the numeral 1 is a cassette case, the base of which is provided with a hole 2. Two small holes 3*a*, 3*b* are mounted near the side portions of the base, as shown in FIG. 1*b*.

FIG. 2 shows a bottom plate 4 to be enclosed in the cassette case 1. The bottom plate 4 is provided with legs 4*a*, 4*b*. When the bottom plate 4 is put in the cassette case 1, these legs 4*a* and 4*b* are loosely fitted in the described small holes 3*a*, 3*b*, respectively.

Copy paper is placed on the bottom plate 4 enclosed in the cassette case 1. When the cassette case 1 is loaded into a copying machine, a vertical upward force is applied from a part of the copying machine through the holes 2 of the cassette case 1, which causes the bottom plate 4 to turn on the legs 4*a*, 4*b* loosely fitted in the small holes 3*a*, 3*b* so as to obliquely lift up the copy paper on the bottom plate 4. Thus, the copy paper is in position to feed out in direction of an arrow Z in FIG. 1*a*.

Since the conventional paper feed cassette is constructed as described above, it is disadvantageous in that one paper feed cassette can feed paper in only one direction, that is, if the direction of copy paper feeding is changed, another paper feed cassette is required, which results in the economical disadvantage that it is necessary to provide two cassettes for longitudinal feed and lateral feed. Accordingly, the present invention overcomes this disadvantage by providing a paper feed cassette which can feed paper both laterally and longitudinally.

SUMMARY OF THE INVENTION

The present invention is directed to the provision of a paper feed cassette having a rectangular base for use in a copying machine comprising a base, two sides of which meet at right angles to each other and are provided with holes formed at the respective substantially central portions thereof, and a bottom late having a fulcrum near at least one side of the two sides having no hole, which is disposed on the base.

DESCRIPTION OF THE PREFERRED EMBODIMENT

Figure 1A:
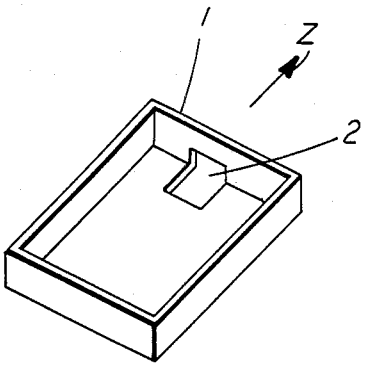
FIG. 1a PRIOR ART
FIG. 1*a* is a perspective view of a conventional cassette.
Figure 1B:
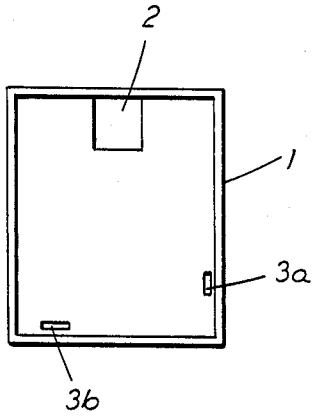
FIG. 1b PRIOR ART
FIG. 1*b* is a plan view of the cassette of FIG. 1*a*.
Figure 2:
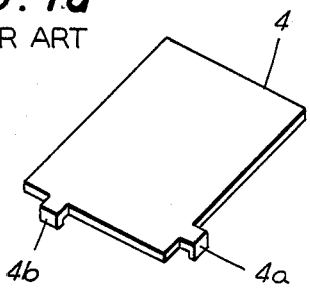
FIG. 2 PRIOR ART
FIG. 2 shows a bottom plate adapted to be inserted into the cassette of FIGS. 1*a* or 1*b*.
Figure 3:
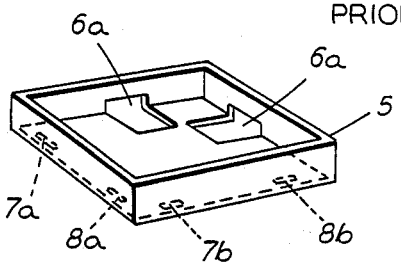
FIG. 3 is a perspective view of one embodiment of the present invention.

In FIG. 3, a cassette case 5 is shown that is preferbly square and has two holes 6*a*, 6*b* which are cut such that they extend from the sides to the base. These holes are formed in such a manner as to respectively span two sides of the base that meet at right angles to each other. The base of the cassette case 5 is provided with small holes 7*a*, 7*b*, 8*a*, and 8b formed near the other two sides where the above holes 6*a*, 6*b* are not spanned.

Figure 4:
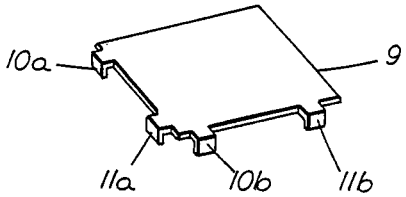
FIG. 4 is a perspective view of the bottom plate used in the cassette of FIG. 3.

As shown in FIG. 4, a bottom plate 9 has legs 10*a*, 10*b*, 11*a*, and 11*b* on two sides thereof meeting at right angles to each other. When the bottom plate 9 is enclosed in the described cassette case 5, the legs 10a and 10b are loosely fitted in the small holes 7*a*, 7*b*, respectively and the legs 11*a*, 11*b* are loosely fitted in the small holes 8*a*, 8*b*, respectively.

Figure 5:
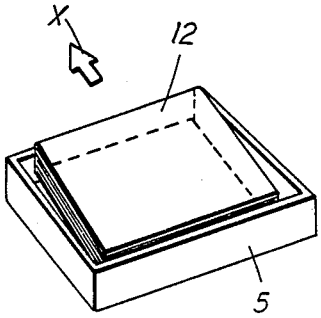
FIGS. 5 and 6 illustrate the thus constructed paper feed cassette loaded with copying paper and inserted in a copying machine.
Figure 6:
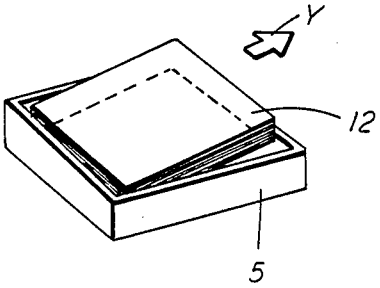

FIGS. 5 and 6 illustrate the thus constructed paper feed cassette on which copy paper is loaded, when it has been inserted into a copying machine. FIG. 5 shows the positioning of cassette 5 where copy paper 12 is fed out in direction of an arrow X, that is, for performing the lateral feed, the paper feed cassette 5 is advanced in direction of the arrow X to be loaded onto or into the copying machine. Whereupon, an upward force from the below is applied through the hole 6a formed on the base of the cassette case to the bottom plate 9 by parts provided in the copying machine, which causes the bottom plate 9 to turn on the legs 11*a*, 11*b*. Thus, copy paper 12 on the bottom plate 9 is inclined as shown in FIG. 5, so that the copy paper is easy to feed out in the direction of the arrow X by suitable feed members.

FIG. 6 shows the situation where the copy paper 12 is fed out in direction of an arrow Y, that is, the case for performing longitudinal feeding. In this case, the cassette case 5 is advanced in the direction of the arrow to be placed into a copying machine. Whereupon, in the same manner as the lateral feed, an upward force is applied through the hole 6*b* to the bottom plate 9, so that the bottom plate 9 is lifted up on the fulcrums of the legs 10*a*, 10*b*, which results in the copy paper 12 on the bottom plate 9 being lifted up. Thus, the copy paper 12 becomes easy to feed out in the direction of the arrow Y. It should be understood that while paper is mentioned herein as the substrate to be fed from cassette 5, any substrate or sheet, e.g., transparencies could replace the paper.

It will be apparent that this invention, as described above, discloses a dual purpose cassette, wherein copy paper can be fed out longitudinally or laterally simply by loading the cassette on a copying machine in the direction of feed desired. Accordingly, a simple and economical paper tray is disclosed which can be used for long edge or short edge feed. The tray has openings on the short edge and long edge of its base. Engagement by a part of the machine is made through these openings with a base plate positioned in the bottom of the cassette which in turn positions sheets in the tray for feeding. This unique tray provides a cost reduction since a customer needs only one tray for multiple functions, i.e., it eliminated searching for "the other cassette" for reduction/enlargement or other desired purpose. In other words, two tray function for the price of one tray.

What is claimed is:

1. In a paper feeding cassette adapted for feeding sheets in or into a copying machine, the paper feeding cassette comprising a base member and four side members enclosing the base member and meeting the base member at right angles and a bottom plate positioned on top of the base and adapted to support the sheets to be fed and pivot about a fulcrum near at least one of the side members, the improvement in which:

at least two of said side members having holes that extend into portions of said base member at substantially central portions thereof, and means external of said holes in said at least two side members and portions of said base member adapted when the cassette is inserted into the copying machine to lift said bottom plate such that the sheet can be fed from the cassette in either a first or second direction depending on which of the holes in said at least two side members is placed in communication with said means external of the cassette.

2. A paper feed cassette, comprising:

a rectangular base member;

four side members enclosing said base member and meeting said base member at right angles, two of said side members having holes that extend into portions of said base member at substantially central portions thereof in order to facilitate positioning of the cassette for paper feeding from the cassette in either of two directions with one of said two directions being at a right angle with respect to the other, and a bottom plate having a fulcrum near at least one side of the two of said side members other than said two side members having holes therein.

3. A cassette for holding stacked substrates for extraction in either of two orthogonal directions, including a base member, at least two orthogonal sides contiguous to the base and to each other, two apertures through the base and the adjacent sides, and a bottom late adapted to support stacked substrates thereon and to be tilted by means external to said cassette extending through the apertures in order to position the substrates for extraction, and wherein the direction along which the substrates can be extracted is dependent upon the orientation of the cassette, said base member being enclosed by four orthogonal sides, and wherein said apertures are positioned centrally of the respective sides, and wherein said bottom plate has at one fulcrum near at least on of the sides other than the sides with apertures.

4. The cassette of claim 3, in which the bottom plate has two legs projecting from each of two orthogonal edge surfaces thereof, there being two pairs of complementary passages in the cassette base in which the legs engage to provide alternative pivots for the bottom plate.

* * * * *